US007717829B2

(12) United States Patent
Wang

(10) Patent No.: US 7,717,829 B2
(45) Date of Patent: May 18, 2010

(54) ENGAGING MECHANISM FOR A FOLDING APPARATUS OF A TREADMILL

(76) Inventor: Leao Wang, No. 1, Lane 233, Sec. 2, Charng Long. Rd., Taiping 411 (TW)

( * ) Notice: Subject to any disclaimer, the term of this patent is extended or adjusted under 35 U.S.C. 154(b) by 237 days.

(21) Appl. No.: 11/962,107

(22) Filed: Dec. 21, 2007

(65) Prior Publication Data

US 2009/0163326 A1 Jun. 25, 2009

(51) Int. Cl.
*A63B 22/02* (2006.01)

(52) U.S. Cl. ..... 482/54; 482/51

(58) Field of Classification Search ..... 482/54, 482/51

See application file for complete search history.

(56) References Cited

U.S. PATENT DOCUMENTS 5,279,528 A * 1/1994 Dalebout et al. ..... 482/54
6,682,460 B2 * 1/2004 Lo et al. ..... 482/54
6,695,751 B1 * 2/2004 Hsu ..... 482/54
6,905,443 B1 * 6/2005 Lo ..... 482/54
6,913,562 B2 * 7/2005 Chen ..... 482/54
6,984,193 B2 * 1/2006 Chen ..... 482/54
7,104,930 B2 * 9/2006 Lo et al. ..... 482/54
2004/0142796 A1 * 7/2004 Cheng ..... 482/54
2004/0152564 A1 * 8/2004 Kuo ..... 482/54
2006/0040798 A1 * 2/2006 Weier et al. ..... 482/54
2006/0122037 A1 * 6/2006 Chou Lin ..... 482/54
2006/0142124 A1 * 6/2006 Lo ..... 482/54

* cited by examiner

*Primary Examiner*—Fenn C Mathew
*Assistant Examiner*—Andrew M Tecco

(57) ABSTRACT

The invention relates to an engaging mechanism for a folding apparatus of a treadmill that is adapted to apply a proper engaging force to a positioning plate fixed at the bottom of the internal side of the handrail assembly such that an unexpected false pushing action caused by the driving behavior of a slope adjusting support by the lifting motor is prevented when the platform frame of the treadmill is moved in a horizontal operational position.

3 Claims, 6 Drawing Sheets

ENGAGING MECHANISM FOR A FOLDING APPARATUS OF A TREADMILL

BACKGROUND OF THE INVENTION

1. Fields of the Invention

The invention relates to an engaging mechanism for a folding apparatus of a treadmill, and more particularly, to an engaging mechanism that prevents the folding apparatus from an unexpected false action.

2. Description of the Related Art

In the application Ser. Nos. 11/900,042 and 11/866,999, the inventor of the invention has developed a folding apparatus of a treadmill that permits an easy folding of the platform frame in an upright position and even an easy folding of a handrail assembly. In this way, a complete folding is achieved. It is apparent that the inventor has made every effort to enhance the practicality and convenience of the product in the actual use. However, the inventor still found that it is likely to create a certain extent of sway on the platform frame and the handrail assembly due to the existence of the folding apparatus, thereby causing users to have little psychological anxiety and misgivings when the platform frame of the treadmill is moved in a horizontal operational position and the user wants to employ the lifting motor and the slope adjusting support to adjust the exercise slope.

In fact, any treadmill having a folding apparatus for providing an auxiliary force creates a varying degree of sway when the mechanism for adjusting the exercise slope is operated. The slight sway won't harm the operators. In order to eliminate the misgiving of the operator in use, a further solution is developed again.

SUMMARY OF THE INVENTION

It is a primary object of the invention to eliminate the above-mentioned drawbacks and to provide an engaging mechanism for a folding apparatus of a treadmill that avoids the above-mentioned swaying phenomenon so as to enhance the structural stability in using the treadmill. In this way, the operator does not have additional mental burden and apprehensiveness.

According the invention, an engaging mechanism applies a proper engaging force to a positioning plate fixed at the bottom of the internal side of the handrail assembly such that an unexpected false pushing action caused by the driving behavior of a slope adjusting support by the lifting motor is prevented when the platform frame of the treadmill is moved in a horizontal operational position.

DETAILED DESCRIPTION OF THE PREFERRED EMBODIMENT

The present invention will now be described in more detail hereinafter with reference to the accompanying drawings that show various embodiments of the invention.

Figure 1:
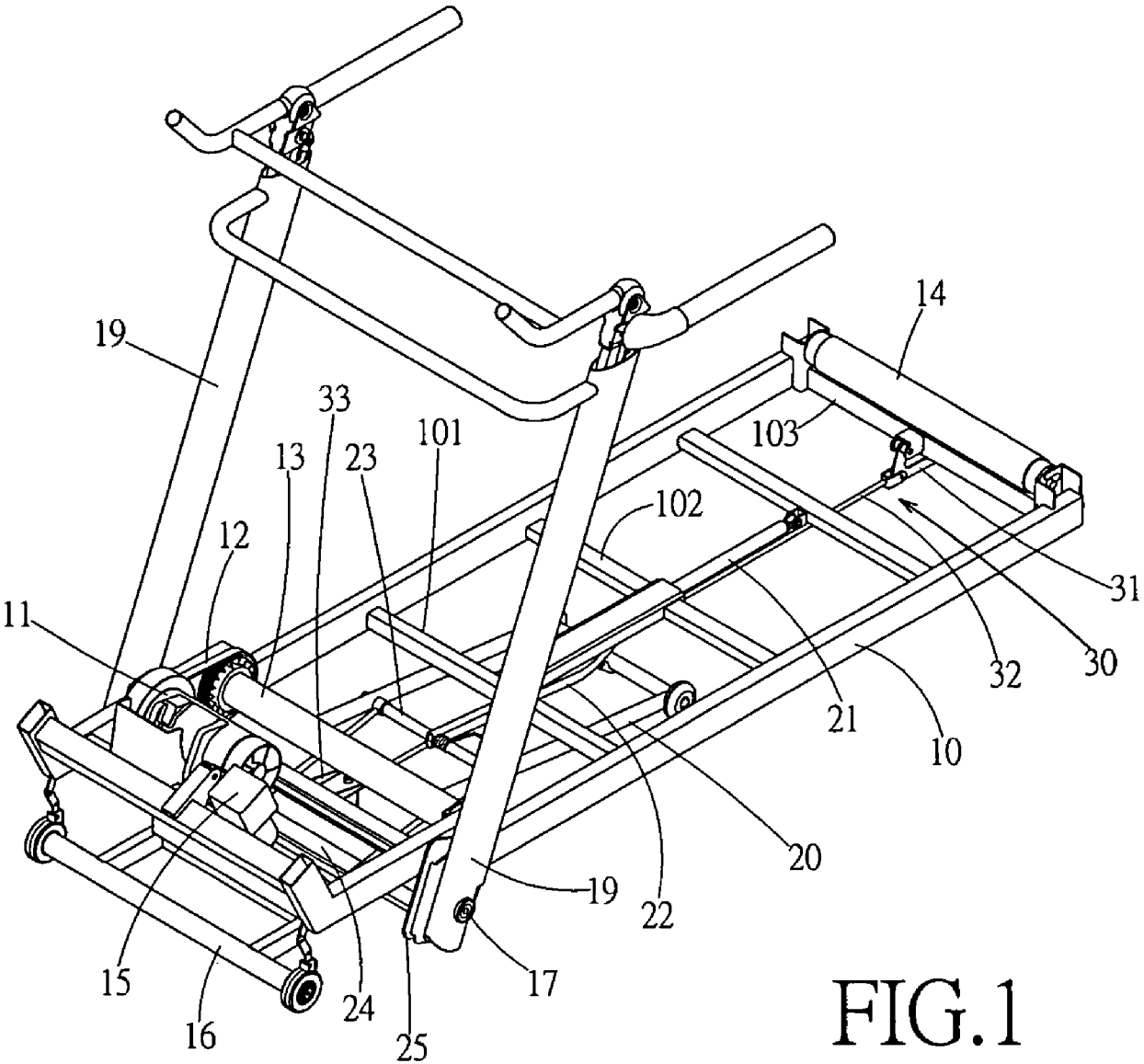
FIG. 1 is a perspective view of a preferred embodiment of the invention.
Figure 2:
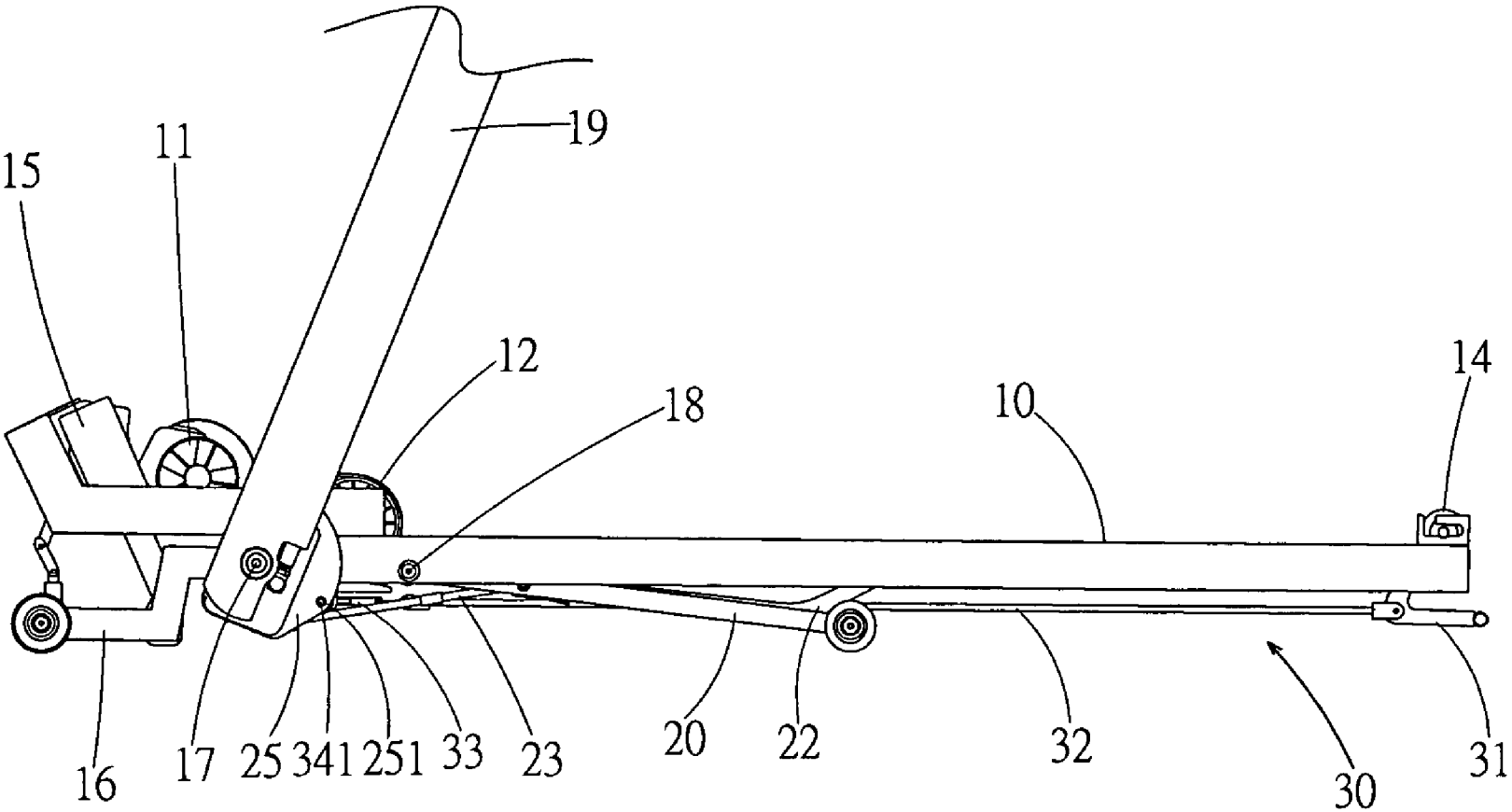
FIG. 2 is a side view of FIG. 1.
Figure 3:
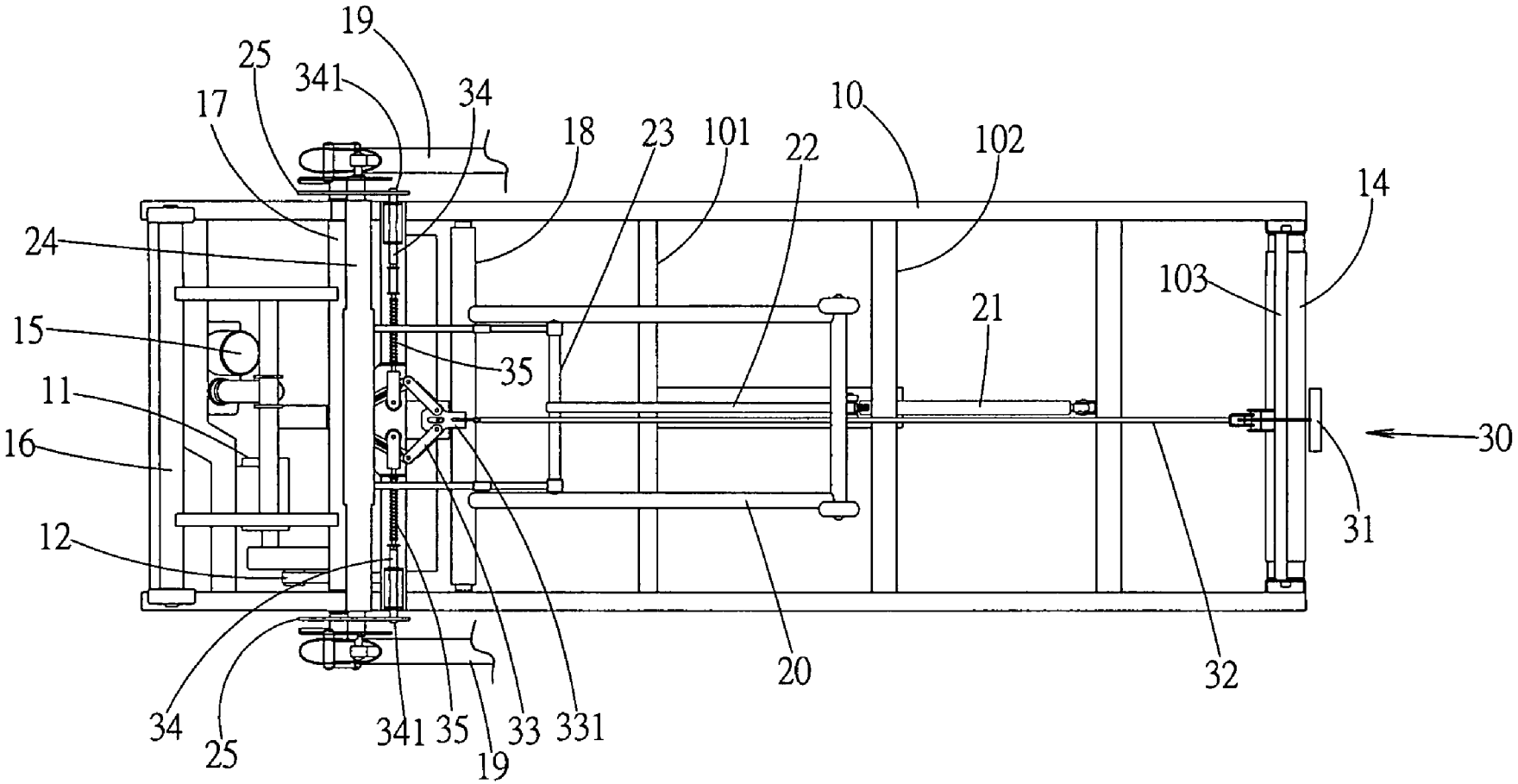
FIG. 3 is a bottom view of FIG. 1.

Referring to FIGS. 1, 2 and 3 in which a preferred embodiment of the invention is illustrated, a platform frame 10 includes a transmission motor 11 at one side thereof for driving a continuous moving belt (not shown) into rotation by use of a transmission belt 12, a front roller 13, and a rear roller 14. Meanwhile, a lifting motor 15 is employed to move an adjusting support 16 upward and downward for adjusting the supporting angle of the platform frame 10. Moreover, two connection pins 17, 18 are disposed at both sides of the platform frame 10, respectively, for pivotally coupling a handrail assembly 19 and a rear support 20, respectively.

Moreover, a slide pusher 22, to which a pneumatic cylinder 21 applies a pushing force, is interposed between a first and a second strengthening bar 101, 102. The other end of the slide pusher 22 is pivotally connected to the rear support 20. Besides, a coupling rod 23 is interposed between the rear support 20 and the handrail assembly 19. As a result, the handrail assembly 19 can be folded up by the coupling rod 23 in cooperation with a crossbar 24. Thus, a folding apparatus of a treadmill is created by the above-mentioned components.

Figure 4:
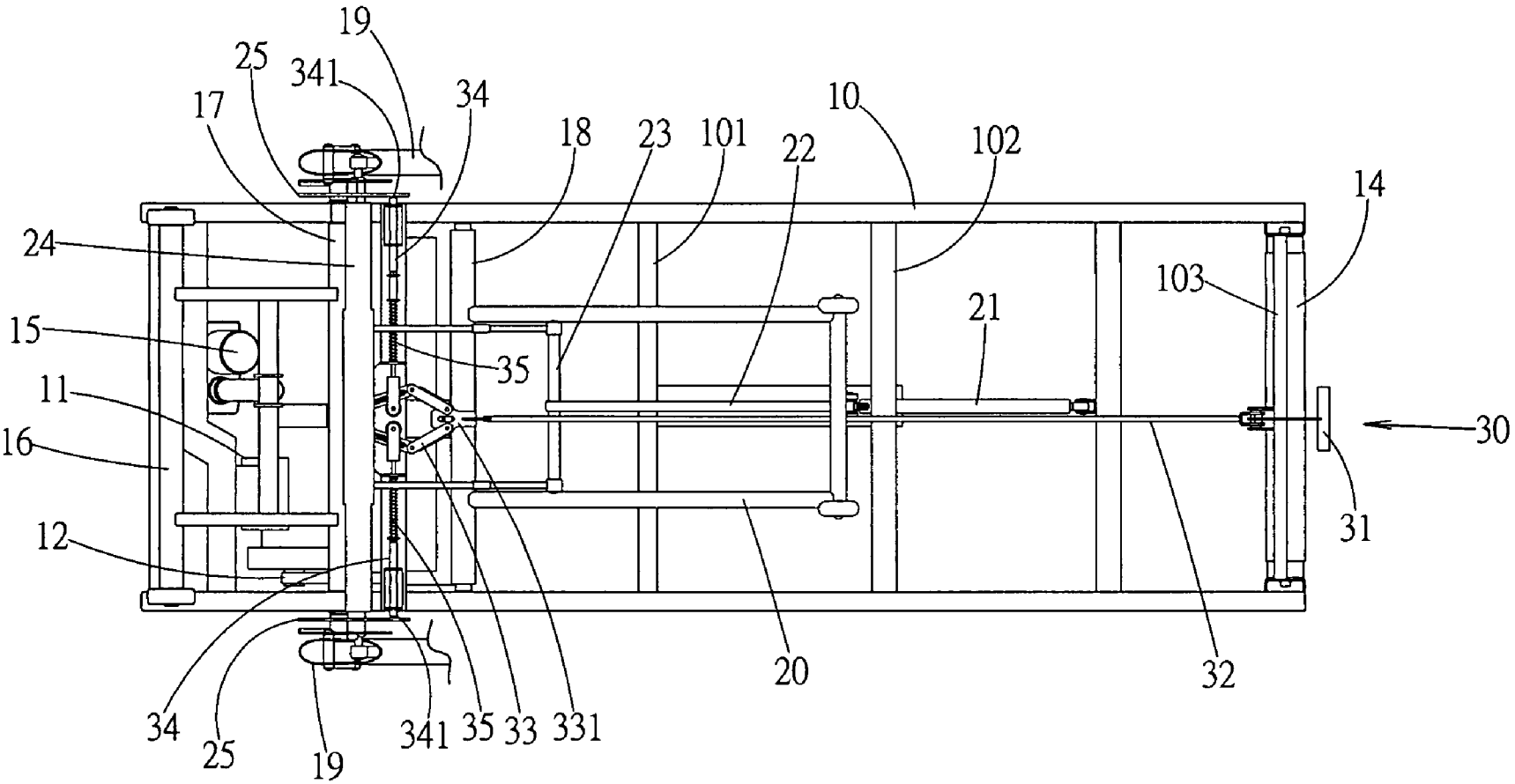
FIG. 4 is a side view of the operation of the structure of FIG. 3.
Figure 5:
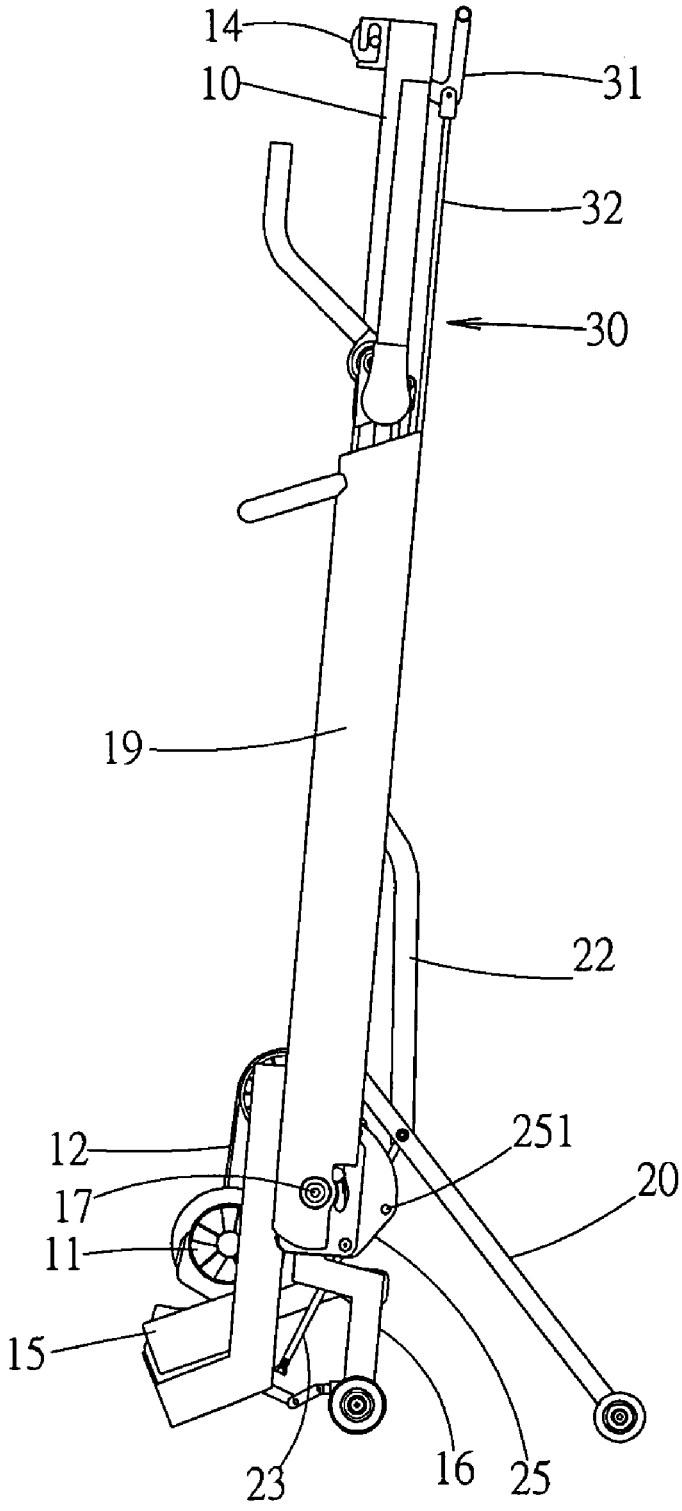
FIG. 5 is a schematic drawing of the structure of FIG. 1 in a folded position.

Referring to FIGS. 3 through 5, an engaging mechanism 30 is disposed at the bottom of a strengthening bar 103 of the platform frame 10. The engaging mechanism 30 applies a proper engaging force to a positioning plate 25 fixed at the bottom of the internal side of the handrail assembly 19 when the platform frame 10 is brought in a horizontal application position.

The engaging mechanism 30 consists of an operating lever 31, an elongated coupling lock piece 32, a quadruple connecting mechanism 33, two protruding studs 34 and two elastic elements 35. An external member 341 of the protruding studs 34 is engaged into a first insertion hole 251 of the positioning plate 25 in place (see FIG. 3) when the platform frame 10 is brought in a horizontal application position. The quadruple connecting mechanism 33 consists of four connecting rods which are pivotally coupled together. When the coupling lock piece 32 is pulled by the operating lever 31, a pivot joint 331 of the quadruple connecting mechanism 33 is pulled in such a way that the quadruple connecting mechanism 33 is brought into a contracting shape distortion state. The protruding studs 34 are attached to a pulled portion at an opposing end of the quadruple connecting mechanism 33. Therefore, the protruding studs 34 are laterally shifted toward the internal side of the platform frame 10 due to the contracting deformation of the quadruple connecting mechanism 33. In this way, the external member 341 can be disengaged from the first insertion hole 251 of the positioning plate 25 (see FIG. 4). Accordingly, the platform frame 10 may be lifted upwards in a folded position (see FIG. 5).

Likewise, the quadruple connecting mechanism 33 is returned back to the original position under the influence of the resilience of the elastic elements 35 when the platform frame 10 is lowered from the upright folded position to the horizontal application position. In this way, the external members 341 of the protruding studs 34 are engaged into the first insertion holes 251 of the positioning plates 25 again and automatically returned in the state as shown in FIG. 3. As a result, any adverse effect of the above-mentioned can be avoided when the operator employs the lifting motor 15 and the adjusting support 16 to adjust the exercise slope.

Figure 6:
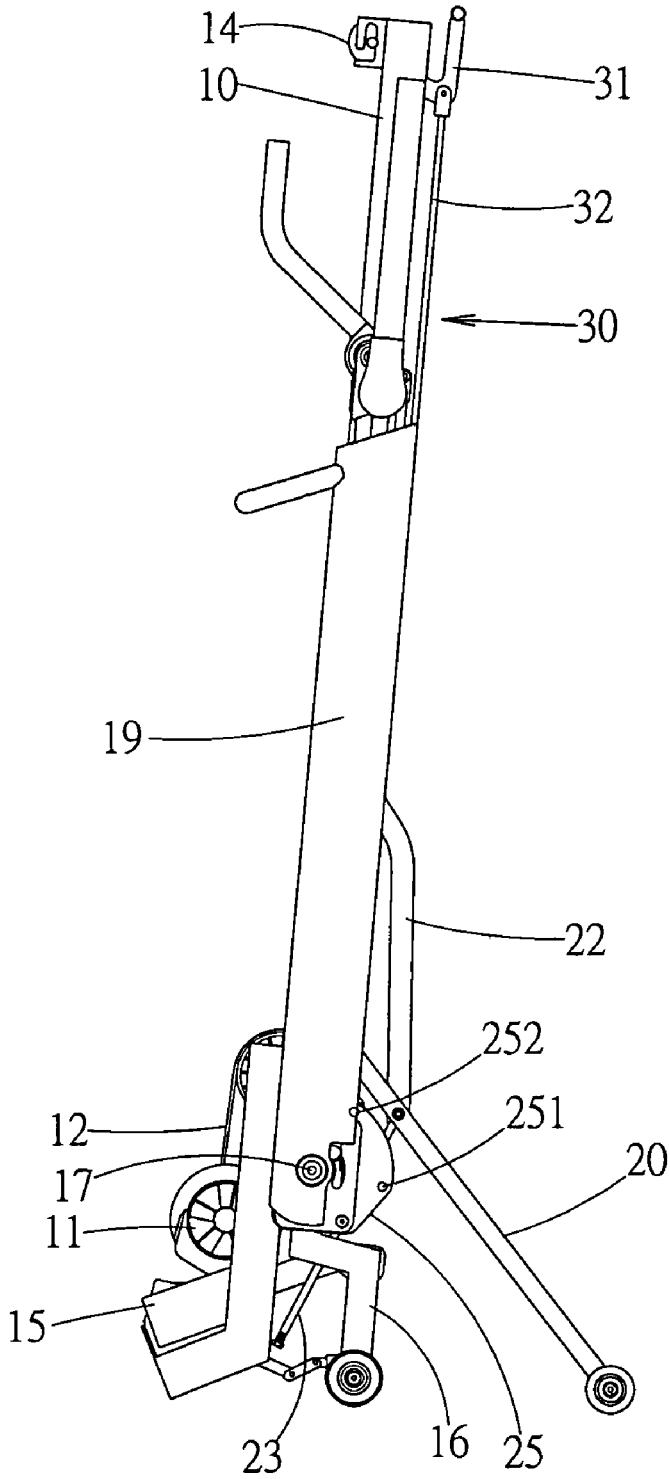
FIG. 6 is a schematic drawing of another embodiment of the invention.

As shown in FIG. 6, a second insertion hole 252 is formed in the positioning plate 25. The external member 341 of the protruding stud 34 can also be automatically engaged into the second insertion hole 252 when the platform frame 10 is brought into the upright folded position. In this way, an unexpected rollover of the platform frame can be prevented, thereby greatly enhancing the operation safety.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A folding apparatus of a treadmill having a platform frame with a transmission motor at one side thereof for driving a continuous moving belt into rotation by use of a transmission belt, a front roller, and a rear roller, a lifting motor being employed to move an adjusting support upward and downward for adjusting the supporting angle of the platform frame, two connection pins being disposed at both sides of the platform frame, respectively, for pivotally coupling a handrail assembly and a rear support, respectively, wherein a slide pusher, to which a pneumatic cylinder applies a pushing force, is interposed between a first and a second strengthening bar while the other end of the slide pusher is pivotally connected to the rear support, whereupon a coupling rod is interposed between the rear support and the handrail assembly; accordingly, the handrail assembly may be folded up by the coupling rod in cooperation with a crossbar; and wherein an engaging mechanism is disposed at the bottom of a strengthening bar of the platform frame such that the engaging mechanism applies a proper engaging force to a positioning plate fixed at the bottom of the internal side of the handrail assembly when the platform frame is brought in a horizontal application position, whereby any unexpected false pushing action is avoided when the lifting motor and the adjusting support are employed to adjust the exercise slope.

2. A folding apparatus of a treadmill having a platform frame with a transmission motor at one side thereof for driving a continuous moving belt into rotation by use of a transmission belt, a front roller, and a rear roller, a lifting motor being employed to move an adjusting support upward and downward for adjusting the supporting angle of the platform frame, two connection pins being disposed at both sides of the platform frame, respectively, for pivotally coupling a handrail assembly and a rear support, respectively, wherein a slide pusher, to which a pneumatic cylinder applies a pushing force, is interposed between a first and a second strengthening bar while the other end of the slide pusher is pivotally connected to the rear support, whereupon a coupling rod is interposed between the rear support and the handrail assembly; accordingly, the handrail assembly may be folded up by the coupling rod in cooperation with a crossbar;

wherein an engaging mechanism is disposed at the bottom of a strengthening bar of the platform frame such that the engaging mechanism applies a proper engaging force to a positioning plate fixed at the bottom of the internal side of the handrail assembly when the platform frame is brought in a horizontal application position;

wherein the engaging mechanism consists of an operating lever, an elongated coupling lock piece, an quadruple connecting mechanism, two protruding studs and two elastic elements, and wherein an external member of the protruding studs is engaged into a first insertion hole of the positioning plate in place when the platform frame is brought in a horizontal application position;

wherein the quadruple connecting mechanism consists of four connecting rods which are pivotally coupled together, and wherein when the coupling lock piece is pulled by the operating lever, a pivot joint of the quadruple connecting mechanism is pulled in such a way that the quadruple connecting mechanism is brought into a contracting shape distortion state, and wherein the protruding studs are attached to a pulled portion at an opposing end of the quadruple connecting mechanism so that the protruding studs are laterally shifted toward the internal side of the platform frame due to the contracting deformation of the quadruple connecting mechanism, and the external member can be disengaged from the first insertion hole of the positioning plate; accordingly, the platform frame may be lifted upwards in a folded position; and wherein the quadruple connecting mechanism is returned back to the original position under the influence of the resilience of the elastic elements when the platform frame is lowered from the upright folded position to the horizontal application position such that the external members of the protruding studs are engaged into the first insertion holes of the positioning plates in place.

3. The engaging mechanism for a folding apparatus of a treadmill as claimed in claim 2 wherein a second insertion hole is formed in the positioning plate, and wherein the external member of the protruding stud can also be automatically engaged into the second insertion hole when the platform frame is brought into the upright folded position such that an unexpected rollover of the platform frame can be prevented.

* * * * *